US006168756B1

(12) United States Patent
Hirasawa et al.

(10) Patent No.: US 6,168,756 B1
(45) Date of Patent: Jan. 2, 2001

(54) HIGHLY CORROSION-RESISTANT CHROMIUM-CONTAINING STEEL WITH EXCELLENT OXIDATION RESISTANCE AND INTERGRANULAR CORROSION RESISTANCE

(75) Inventors: Junichiro Hirasawa; Atsushi Miyazaki; Kazuhide Ishii; Susumu Satoh; Haruhiko Ishizuka, all of Chiba (JP)

(73) Assignee: Kawasaki Steel Corporation, Hyogo (JP)

( * ) Notice: Under 35 U.S.C. 154(b), the term of this patent shall be extended for 0 days.

(21) Appl. No.: 09/431,171

(22) Filed: Nov. 1, 1999

(30) Foreign Application Priority Data

Nov. 2, 1998 (JP) ..... 10-312292

(51) Int. Cl.[7] ..... C22C 38/34; C22C 38/28
(52) U.S. Cl. ..... 420/70; 420/104
(58) Field of Search ..... 420/104, 110, 420/70

(56) References Cited

U.S. PATENT DOCUMENTS 3,770,394 11/1973 Bressanelli .
5,049,210 * 9/1991 Miyasaka et al. ..... 420/104

FOREIGN PATENT DOCUMENTS 0 145 471 6/1985 (EP) .
55-54550 * 4/1980 (JP) ..... 420/104
55-161049 * 12 1980 (JP) ..... 420/34
58-224148 12/1983 (JP) .
60-13057 * 1/1985 (JP) ..... 420/104
6-248394 9/1994 (JP) .
8-035010 2/1996 (JP) .

* cited by examiner

*Primary Examiner*—Deborah Yee
(74) *Attorney, Agent, or Firm*—Young & Thompson

(57) ABSTRACT

A highly corrosion resistant chromium-containing steel has corrosion resistance and oxidation resistance comparable or superior to those of low Cr-stainless steel (Cr content: 11–13% by weight), and excellent intergranular corrosion resistance not attainable in existing chromium containing steels. However, the steel has such a low Cr content that it is not classified as a stainless steel. A preferred composition on a weight % basis, is: C: 0.015% or less, Si: from more than 1.0% to 2.0%, Mn: 0.5% or less, P: 0.05% or less, S: 0.01 or less, Ni: 0.015% or less, provided that sum of the C content and the N content (C+N): 0.020% or less. Ti: from more than 0.30% to 0.50% in which the contents for Cr, Ti, C and N, that is, [Cr], [Ti], [C] and [N] satisfying the following relation: $[Ti]/([C]+[N]) \geqq 64-4\times[Cr]$, balance of Fe and incidental impurities.

9 Claims, 1 Drawing Sheet

HIGHLY CORROSION-RESISTANT CHROMIUM-CONTAINING STEEL WITH EXCELLENT OXIDATION RESISTANCE AND INTERGRANULAR CORROSION RESISTANCE

BACKGROUND OF THE INVENTION

1. Field of the Invention

The present invention concerns a highly corrosion resistant chromium-containing steel having corrosion resistance and oxidation resistance comparable or superior to those of low chromium (Cr) stainless steels and further having excellent intergranular corrosion resistance not offered by existing chromium containing steels, and despite having such a low Cr content as not to be included in the category of stainless steels.

2. Description of the Related Art

Typical corrosion resistant stainless steels contain 11% by weight or more of chromium. However, since Cr is expensive, there is a need for a steel composition that maintains its desirable characteristics even when the amount of chromium is decreased. Techniques for adding Si to compensate for a decrease in corrosion resistance of steels with lower chromium have been proposed. For example, Japanese Unexamined Patent Publication No. 58-224148 proposed chromium steels as components of automobile exhaust systems having a Cr content of from more than 5.0% by weight to less than 10.0% by weight with addition of more than 1.5% to less than 3.0% by weight of Si and 0.3% by weight or less of Ti. Furthermore, Japanese Unexamined Patent Publication No. 5-279791 proposed steels for internal combustion engine exhaust systems of excellent wet corrosion resistance in which from 0.01% to less than 1.2% by weight of Si is added to steels with Cr content of 5.5% to 9.9% by weight.

However, those chromium steels had no effective countermeasure against sensitization that is caused when Cr forms compounds with C or N and forms Cr depletion layers at the periphery adjacent those compounds. For example, if the steels are used as exhaust system components in automobiles, they cannot prevent sensitization caused by welding at the time of manufacture or by heating at the high exhaust gas temperatures encountered in use. As a result, Cr is deposited as carbides or nitrides, which causes intergranular corrosion at regions with lowered Cr concentration, thereby accelerating corrosion and even causing breakage of the eroded portion in a worst case.

OBJECT OF THE INVENTION

In view of the above, it is an object of this invention to overcome the foregoing problems and provide a highly corrosion resistant chromium-containing steel having corrosion resistance and oxidation resistance comparable or superior to those of low Cr stainless steels (Cr content: 11–13 wt %) and further having excellent intergranular corrosion resistance not offered by existing chromium containing steels, despite having such a low Cr content as not even to be classified as a stainless steel, through appropriate development of the steel composition.

SUMMARY OF THE INVENTION

For obtaining the foregoing object, the present inventors have made an intense study for the effect of various additive elements on the corrosion resistance, the oxidation resistance and the intergranular corrosion resistance of chromium-containing steels. As a result, it has been found that a steel having corrosion resistance, oxidation resistance and intergranular corrosion resistance comparable to or superior to those of low Cr-stainless steels can be achieved by adding Si and Ti and, optionally, Mo and, further, setting the Ti/(C+N) ratio to a predetermined minimum value in accordance with the Cr content.

The present inventors have found that it is effective to add Si, preferably in excess of a predetermined amount, and to add elements selected from Mo, Cu, Co, Ca, Nb and B for improving the corrosion resistance and the oxidation resistance. It has also been found that the intergranular corrosion resistance can be improved by first improving the corrosion resistance of the matrix by setting the addition amount of, for example, Si and Mo to appropriate values and, further, adding a sufficient amount of Ti while keeping the ratio of the Ti content [Ti] to the sum of the C content [C] and the N content [N]: [Ti]/([C]+[N]) in excess of a predetermined value in accordance with the Cr content [Cr].

The present inventors have conducted a intergranular corrosion test for chromium-containing steel sheets which are based on Fe—9 wt % Cr—1.2 wt % Si and in which the contents of Ti, C and N are varied, and have investigated the relationship of the Cr content [Cr] to the ratio of the Ti content [Ti] to the sum of the C content [C] and the N content [N]: [Ti]/([C]+[N]) in the Cr-containing steels. The results are shown in FIG. 1

In the intergranular corrosion test, a test piece prepared by butt welding two sheets of test specimens by GTA (Gas Tungsten Arc) welding was immersed in a boiling solution of sulfuric acid+copper sulfate for 16 hours, and subjected to a bending test. The presence or absence of intergranular corrosion cracks was confirmed by observing the outer surface of the bend with a magnifying glass. In FIG. 1, ○ represents the absence of intergranular corrosion cracks while ● represents the presence of intergranular corrosion cracks.

As shown in FIG. 1, it has been found that excellent intergranular corrosion resistance can be obtained for 9 wt % Cr—1.2 wt % Si steels by setting the Ti addition amount to more than 0.30% by weight and the value for the relation: [Ti]/([C]+[N]) to 28 or greater. As a result of further study, it was found that a higher value for [Ti]/([C]+[N]) is needed as [Cr] is decreased, in order to obtain a steel having excellent intergranular corrosion resistance. Specifically, a value of (64−4×[Cr]) or greater is necessary for the [Ti]/([C]+[N]) ratio at a Si content of more than 1.0% by weight in accordance with the Cr content [Cr], to best accomplish the objects of the present invention.

A steel composition according to the invention preferably has the following composition, on a weight % basis:

C: about 0.015% or less

Si: from more than about 1.0% to about 2.0%

Mn: about 0.5% or less

P: about 0.05% or less

S: about 0.01% or less

Ni: about 1.0% or less

Cr: from about 5.0% to about 10.4%

Al: about 0.1% or less

N: about 0.015% or less sum of the C content and the N content (C+N): about 0.020% or less Ti: from more than about 0.30% to about 0.50% wherein the contents for Cr, Ti, C and N, that is, [Cr], [Ti], [C] and [N] satisfy the following relation:

$[Ti]/([C]+[N]) \geqq 64-4\times[Cr]$, and the balance Fe and incidental impurities.

A preferred embodiment of this invention provides a highly corrosion resistant chromium-containing steel comprising, on a weight % basis, in addition to the ingredients described above, at least one element selected from:

Mo: from about 0.02% to about 2.0%,

Cu: from about 0.02% to about 2.0%, and

Co: from about 0.02% to about 2.0%.

Another preferred embodiment of this invention provides a highly corrosion resistant chromium-containing steel comprising, on a weight % basis, in addition to the ingredients described above at least one element selected from:

Ca: from about 0.0005% to about 0.0030%,

Nb: from about 0.001% to about 0.030%, and

B: from about 0.0002% to about 0.0050%.

DESCRIPTION OF PREFERRED EMBODIMENTS

Figure 1:
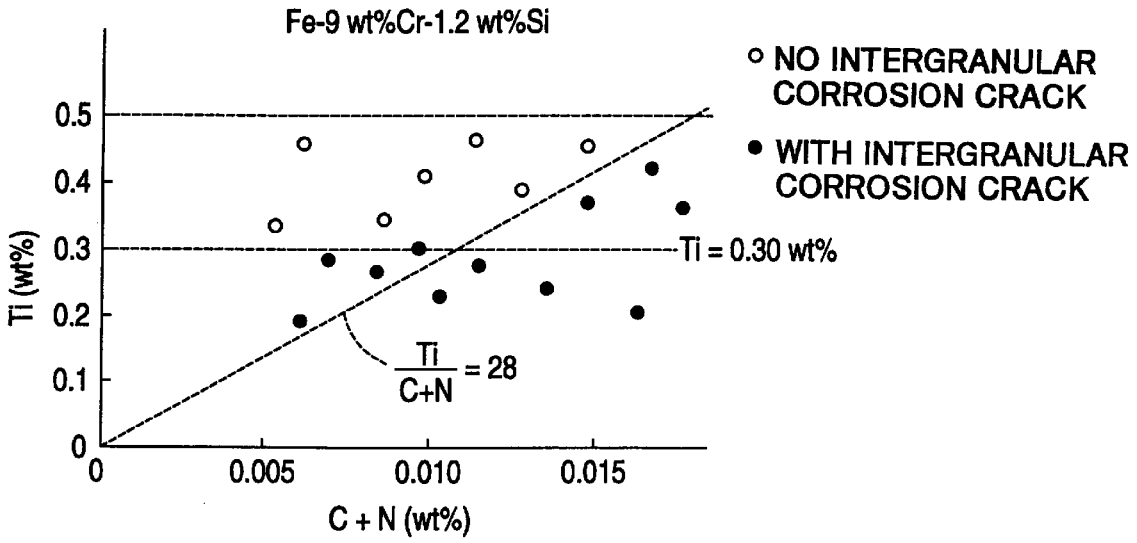
FIG. 1 is a view illustrating the results of an intergranular corrosion test conducted for chromium-containing steels which are based on Fe—9 wt % Cr—1.2 wt % Si steels and in which the contents for Ti, C and N are varied.
Figure 2:
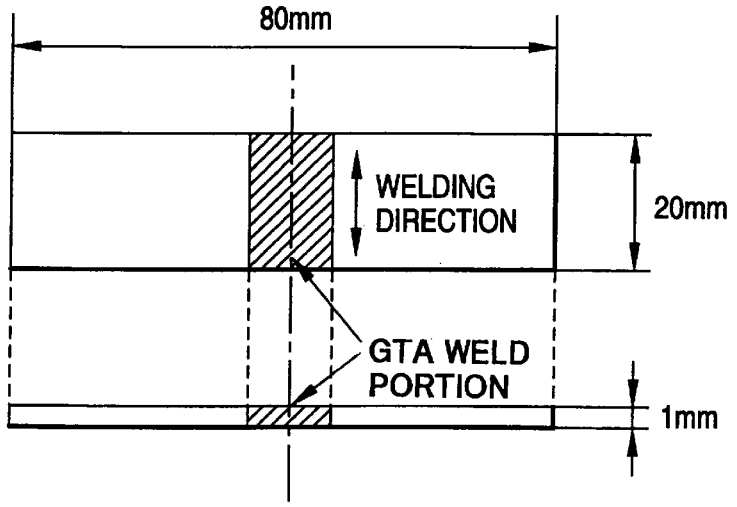
FIG. 2 is a view showing a specimen for intergranular corrosion test.

The highly corrosion resistant chromium-containing steel of this invention (hereinafter simply referred to as "steel of this invention") will now be explained in greater detail.

In the steel of this invention, elemental carbon (C) has a negative impact on corrosion resistance and intergranular corrosion resistance. If the C content exceeds about 0.015% by weight, the undesired effects become remarkable, so that it is restricted to about 0.015% by weight or less. Particularly, a lower C content is more favorable with a view point of improving the corrosion resistance, the oxidation resistance and the intergranular corrosion resistance, and the content is preferably 0.008% by weight or less.

In the steel of this invention, Si improves corrosion resistance, oxidation resistance and intergranular corrosion resistance. For attaining such effects, addition amount of exceeding about 1.0% by weight is desirable. However, in amounts greater than about 2.0% by weight, no added benefit is conferred and the steel is hardened to degrade the workability.

Mn has deoxidizing and desulphurizing effects and is a typical elemental ingredient in steel making. As too great an amount deteriorates the oxidation resistance and the workability of the steel, it is restricted in the invention to about 0.5% by weight or less.

To improve the corrosion resistance and the workability, the P content should be as low as possible and in the invention it is restricted to about 0.05% by weight or less in view of an economical restriction in steel making.

In the steel of this invention, the corrosion resistance is improved as the S content is decreased, and it is restricted to about 0.01% by weight or less in view of an economical restriction imposed on the desulphurizing treatment in steel making. A lower S content is favorable from the view point of corrosion resistance, oxidation resistance and intergranular corrosion resistance, and it is preferably 0.005% by weight or less.

Ni improves the corrosion resistance but since it is expensive and using too much of it increases of the cost, the content is preferably restricted to about 1.0% by weight or less.

In the steel of this invention, Cr improves corrosion resistance, oxidation resistance and intergranular corrosion resistance. Cr should be included at about 5.0% by weight or more for obtaining the corrosion resistance comparable with or superior to that of stainless steels, so this is a lower limit. Since the corrosion resistance, oxidation resistance and intergranular corrosion resistance are improved with increasing amounts of Cr, it is preferably used at about 8.0% by weight or more. However, since Cr is an expensive element and excessive addition increases the cost, it is restricted to about 10.4% by weight or less. In this invention, sufficient corrosion resistance, oxidation resistance and intergranular corrosion resistance can be obtained even if the Cr content is less than about 10.0% by weight.

In the steel of this invention, Al is preferably used as a deoxidizing agent in steel making; however, as excess addition forms inclusions which would cause degradation of the corrosion resistance and the surface property, it is restricted to about 0.1% by weight or less.

Further, N is an element that has an adverse impact on the corrosion resistance and the intergranular corrosion resistance, especially if the content exceeds 0.015% by weight; therefore, its presence is preferably restricted to about 0.015% by weight or less.

In the steel of this invention, lower N content is favorable from the view point of improving the corrosion resistance, the oxidation resistance and the intergranular corrosion resistance and it is preferably about 0.008% by weight or less.

Further, in the steel of this invention, the sum of the C content and the N content (C+N) is restricted to about 0.020% by weight or less from the view point of improving the corrosion resistance and the intergranular corrosion resistance. The sum for the C content and the N content (C+N) is preferably lower still, to further improve the corrosion resistance, the oxidation resistance and the intergranular corrosion resistance and it is preferably about 0.015% by weight or less.

Ti is useful in the invention for fixing C and N in the steel and improving the corrosion resistance and the intergranular corrosion resistance. The effect of improving the corrosion resistance and the intergranular corrosion resistance with Ti can be obtained when the Ti content exceeds about 0.30% by weight within a range of the Cr content in the steel of this invention. However, when Ti is incorporated in excess of 0.50% by weight, no better effect is obtained, and also this forms inclusions that would cause degradation of the corrosion resistance or surface flaws; therefore, the Ti content is preferably about 0.50% by weight or less.

Further, in the steel of this invention the contents of Cr, Ti, C and N, that is, [Cr], [Ti], [C] and [N] satisfy the following relation, within the range of [Cr] from about 5 to about 10.4% by weight.

$$[Ti]/([C]+[N]) \geqq 64-4\times[Cr]$$

In the relation, if the value of the left side of the relation ([Ti])/([C]+[N])) were smaller than the value for the right side of the relation (64−4×[Cr]), then C and N would not be fixed sufficiently as Ti compounds, and Cr compounds would be formed in large amounts, so that Cr depletion layers would be formed at the grain boundaries tending to cause intergranular corrosion. In stainless steel with a Cr content of 11% by weight or more, the value for the relation [Ti]/([C]+[N]) is typically 11 or more. In accordance with the finding of the present inventors, however, in a steel with Cr content of less than 11% by weight, intergranular corrosion becomes remarkable when the Cr carbides and nitrides are deposited at the grain boundaries, since the Cr content is lower in the matrix, so that it is necessary for preventing the intergranular corrosion to increase the amount of Ti more than the case where the Cr content is at least 11% by weight, thereby to completely fix C and N with Ti. That is, it is necessary that the value for the relation [Ti]/([C]+[N]) is greater. Furthermore, it has also been found that a still greater value for [Ti]/([C]+[N]) is beneficial for decreasing amounts of Cr, which led to the development of the above-mentioned relation.

In the steel of this invention, corrosion resistance is improved by adding at least one elemental ingredient selected from Mo, Cu and Co in addition to the essential ingredients described above. Mo, Cu or Co may be added alone or as a combination of two or more of them. Any of Mo, Cu or Co has an effect of improving the corrosion resistance by the addition of 0.02% by weight or more. Addition of 0.1% by weight or more is preferred for obtaining a further excellent effect of improving the corrosion resistance. However, if each of Mo, Cu or Co is incorporated in excess of 2.0% by weight, not only is the effect saturated but also it impairs the workability and economical performance.

Furthermore, in the steel of this invention, oxidation resistance is improved if at least one of elemental ingredient selected from Ca, Nb and B is incorporated in addition to the essential elements as described above and at least one element selected from Mo, Cu and Co which is added optionally. Ca, Nb and B may be added alone or as a combination of two or more of them. Particularly, in view of the improvement for the oxidation resistance, it is effective to add one or more elements selected from at least about 0.0005% by weight of Ca, about 0.001% by weight of Nb and about 0.0002% by weight of B. Furthermore, as excess addition of the element causes deterioration of the toughness of steel, the upper limit for the addition amount is preferably restricted to about 0.003% by weight for Ca, about 0.030% by weight for Nb and about 0.0050% by weight for B, respectively.

The method of manufacturing the steel of this invention is not particularly limited and methods employed generally for the production of Cr-containing steels such as stainless steel can be applied with minimal adaptation. For example, a method of preparing the essential and optional elements by melting them in a converter furnace or an electric furnace and conducting secondary refinement by VOD is suitable. The thus prepared molten steel can be formed into steel materials in accordance with usual known casting methods, and application of a continuous casting method is favorable in view of the productivity and the quality.

The steel material obtained by continuous casting may then be heated to a predetermined temperature and then hot rolled into a hot rolled sheet of a desired sheet thickness.

The hot rolled sheet is preferably annealed at a temperature from 700° to 1050° C. in accordance with the steel compositions and then cold rolled under standard cold rolling conditions to form a cold rolled sheet of a predetermined thickness.

Furthermore, the cold rolled sheet is preferably annealed at a temperature from 700 to 1030° C. and pickled depending on the steel composition to form a cold rolled annealed sheet.

Depending on the intended application, the hot rolled sheet or the hot rolled annealed sheet may then be ready for use.

Furthermore, the shape and the form of the steel of this invention are not particularly limited and this invention is applicable not only to sheet materials but also to any shape and form of fabricated products such as pipes, pressed products and wire materials.

EXAMPLES

The following inventive and comparative examples will further illustrate the invention.

Chromium-containing steels having chemical compositions shown in Table 1–Table 4 (steels of this invention (1–11) in Table 1 and Table 2, Comparative Examples (A–H) in Table 3 and Table 4) were prepared by melting 50 kg of steel ingots in a vacuum melting furnace, hot rolling by a standard method to sheets of 3 mm thickness, annealing and then cold rolling to produce sheets of 1 mm thickness. Subsequently, finishing annealing and pickling were conducted to obtain cold rolled annealed sheets of 1 mm thickness. The cold rolled annealed sheets were used as test specimens to evaluate the corrosion resistance, the oxidation resistance and the intergranular corrosion resistance in accordance with the following methods. The results are shown in Table 2 and Table 4.

Corrosion Resistance:

Two samples (70×150 mm) were taken from each of the test specimens and a salt spray test (hereinafter referred to as SST test) was conducted on the samples for one hour in accordance with Japanese Industrial Standard (JIS) Z 2371. Next, the ratio of rust-forming area to the entire surface of each sample in average was evaluated based on the following criteria.

◎ The rust forming area ratio is 5% or less, showing most favorable corrosion resistance ○ The rust forming area ratio is more than 5% and less than 20%, showing favorable corrosion resistance X The rust forming area ratio is more than 20%, showing substantial deterioration of corrosion resistance Oxidation Resistance:

Three samples (20×30 mm) were taken from each of the test specimens, the samples were left in a furnace of ambient atmosphere kept at 850° C. in accordance with JIS Z2281, taken out of the furnace after 100 hours, air cooled and weighed, and the index for the oxidation resistance was shown by the average value for the mass gain of the sample unit area by oxidation.

Intergranular Corrosion Resistance:

After butt welding the test specimens by GTA welding (voltage: 12 V, current: 150 A, Ar shield gas: 10 liter/min for the surface (on the side of the electrode), 5 liter/min for the rear face, welding speed at 60 cm/min), two specimens (20×80 mm) were taken such that the center of the weld portion was at the center of the sample. They were immersed in a boiling mixed solution of 2% sulfuric acid+6% copper sulfate (the amount of solution is 256 ml or more per one specimen) for 16 hours. Subsequently, a bending test was conducted with the surface of the weld portion as the outside of the bend, by a bending method with an inner radius r=2 mm and bending angle of 180° in accordance with JIS Z 2248, and the weld portion on the outside of the bend and the base metal portion were observed with a magnifying glass to examine cracks caused by intergranular corrosion.

As is apparent from Table 2 to Table 4, the chromium-containing steels of this invention have excellent corrosion resistance, oxidation resistance and intergranular corrosion resistance.

The steel of this invention is a chromium-containing steel of excellent corrosion resistance, oxidation resistance and intergranular corrosion resistance. Since this steel has corrosion resistance, oxidation resistance and intergranular corrosion resistance comparable or superior to those of low-Cr stainless steel, and the material cost is reduced compared with existing stainless steels containing 11% by weight or more of expensive Cr, it is applicable to a wide range of uses for which low chromium stainless steels are used at present. Particularly, this is suitable as a material for exhaust pipes or mufflers in automobile exhaust systems requiring corrosion resistance for the starting material and the weld portion and oxidation resistance when kept at a high temperature.

TABLE 1

| | | Composition (wt %) | | | | | | | | |
|---|---|---|---|---|---|---|---|---|---|---|
| | No. | C | Si | Mn | P | S | Ni | Cr | Al | N |
| Steel of invention | 1 | 0.004 | 1.1 | 0.25 | 0.02 | 0.003 | 0.05 | 10.4 | 0.10 | 0.006 |
| | 2 | 0.006 | 1.5 | 0.35 | 0.03 | 0.003 | 0.08 | 8.5 | 0.09 | 0.008 |
| | 3 | 0.008 | 1.1 | 0.25 | 0.03 | 0.003 | 0.12 | 9.9 | 0.08 | 0.010 |
| | 4 | 0.005 | 1.2 | 0.45 | 0.05 | 0.002 | 0.03 | 8.1 | 0.09 | 0.004 |
| | 5 | 0.014 | 2.0 | 0.25 | 0.02 | 0.005 | 0.05 | 9.8 | 0.07 | 0.005 |
| | 6 | 0.003 | 1.7 | 0.15 | 0.04 | 0.004 | 0.02 | 6.3 | 0.05 | 0.007 |
| | 7 | 0.006 | 1.1 | 0.25 | 0.03 | 0.003 | 0.08 | 9.7 | 0.08 | 0.006 |
| | 8 | 0.004 | 1.2 | 0.35 | 0.02 | 0.002 | 0.07 | 9.2 | 0.06 | 0.005 |
| | 9 | 0.004 | 1.3 | 0.25 | 0.03 | 0.003 | 0.08 | 9.6 | 0.07 | 0.006 |
| | 10 | 0.004 | 1.3 | 0.35 | 0.03 | 0.003 | 0.07 | 9.4 | 0.06 | 0.004 |
| | 11 | 0.005 | 1.2 | 0.10 | 0.03 | 0.002 | 0.05 | 9.8 | 0.08 | 0.006 |

TABLE 2

| | | Composition (wt %) | | | | Validity for the relation: Ti/(C + N) ≧ | SST Test (rust forming area ratio) ⊙: 5% or less ○: More than 5%–20% | Oxidation Test Mass gain by Oxidation | Intergranular Corrosion Test ○: No Corrosion Crack |
|---|---|---|---|---|---|---|---|---|---|
| | No. | C + N | Ti | Mo | Others | 64-4 × Cr | X: More than 20% | (mg/cm$^2$) | X: with Corrosion Crack |
| Steel of Invention | 1 | 0.010 | 0.38 | — | — | Valid | ○ | 1.5 | ○ |
| | 2 | 0.014 | 0.48 | 0.25 | Ca: 0.0012 | Valid | ⊙ | 0.9 | ○ |
| | 3 | 0.018 | 0.45 | 1.20 | — | Valid | ○ | 0.7 | ○ |
| | 4 | 0.009 | 0.32 | — | Cu: 0.52<br>B: 0.0008 | Valid | ○ | 1.2 | ○ |
| | 5 | 0.019 | 0.49 | 0.33 | Nb: 0.007 | Valid | ○ | 0.8 | ○ |
| | 6 | 0.010 | 0.40 | — | Co: 0.85 | Valid | ○ | 1.8 | ○ |
| | 7 | 0.012 | 0.34 | 0.35 | Co: 0.21 | Valid | ⊙ | 0.7 | ○ |
| | 8 | 0.009 | 0.33 | 0.82 | Cu: 0.15<br>Ca: 0.0009 | Valid | ⊙ | 0.9 | ○ |
| | 9 | 0.010 | 0.42 | 0.23 | Nb: 0.008<br>B: 0.0005 | Valid | ⊙ | 0.6 | ○ |
| | 10 | 0.008 | 0.37 | 0.89 | Nb: 0.015<br>B: 0.0013 | Valid | ⊙ | 0.8 | ○ |
| | 11 | 0.011 | 0.32 | 0.31 | — | Valid | ⊙ | 0.6 | ○ |

TABLE 3

| | | Composition (wt %) | | | | | | | | |
|---|---|---|---|---|---|---|---|---|---|---|
| | No. | C | Si | Mn | P | 3S | Ni | Cr | Al | N |
| Steel of comparative Example | A | 0.007 | 1.0 | 0.25 | 0.04 | 0.004 | 0.02 | 8.5 | 0.09 | 0.008 |
| | B | 0.003 | 1.8 | 0.15 | 0.03 | 0003 | 0.03 | 4.8 | 0.08 | 0.007 |
| | C | 0.005 | 1.1 | 0.35 | 0.03 | 0.002 | 0.15 | 9.7 | 0.06 | 0.005 |
| | D | 0.010 | 1.7 | 0.35 | 0.05 | 0.003 | 0.06 | 9.9 | 0.08 | 0.012 |
| | E | 0.016 | 1.9 | 0.45 | 0.02 | 0.005 | 0.02 | 9.8 | 0.09 | 0.003 |
| | F | 0.006 | 1.2 | 0.25 | 0.03 | 0.008 | 0.08 | 9.4 | 0.07 | 0.009 |
| | G | 0.004 | 1.1 | 0.35 | 0.03 | 0.005 | 0.07 | 9.8 | 0.07 | 0.014 |
| | H | 0.005 | 1.3 | 0.55 | 0.04 | 0.003 | 0.09 | 9.7 | 0.08 | 0.005 |

TABLE 4

| | | Composition (wt %) | | | | Validity for the relation: Ti/(C + N) ≧ | SST Test (rust forming area ratio) ⊙: 5% or less ○: More than 5%–20% | Oxidation Test Mass gain by Oxidation | Intergranular Corrosion Test ○: No Corrosion Crack |
|---|---|---|---|---|---|---|---|---|---|
| | No. | C + N | Ti | Mo | Others | 64-4 × Cr | X: More than 20% | (mg/cm$^2$) | X: with Corrosion Crack |
| Steel of Com- | A | 0.015 | 0.47 | 0.12 | — | Valid | X | 83.4 | ○ |
| | B | 0.010 | 0.46 | 0.35 | Ca: 0.0008 | Valid | x | 53.2 | x |

TABLE 4-continued

| | No. | Composition (wt %) C + N | Ti | Mo | Others | Validity for the relation: Ti/(C + N) ≧ 64-4 × Cr | SST Test (rust forming area ratio) ⊙: 5% or less ○: More than 5%–20% X: More than 20% | Oxidation Test Mass gain by Oxidation (mg/cm$^2$) | Intergranular Corrosion Test ○: No Corrosion Crack X: with Corrosion Crack |
|---|---|---|---|---|---|---|---|---|---|
| parative Example | C | 0.010 | 0.30 | — | Cu: 0.15 | Valid | ○ | 1.9 | x |
| | D | 0.022 | 0.55 | 0.18 | B: 0.009 | Valid | x | 1.6 | x |
| | E | 0.019 | 0.49 | — | — | Valid | x | 1.8 | ○ |
| | F | 0.015 | 0.35 | 1.85 | B: 0.0010 | Not valid | ○ | 2.0 | x |
| | G | 0.018 | 0.42 | — | Cu: 0.50 | Not valid | ○ | 1.8 | x |
| | H | 0.010 | 0.38 | 0.58 | — | Valid | ○ | 48.5 | ○ |

What is claimed is:

1. A chromium-containing steel comprising, by weight % basis,

C: about 0.015% or less

Si: from more than about 1.0% to about 2.0%

Mn: about 0.5% or less

P: about 0.05% or less

S: about 0.01% or less

Ni: about 1.0% or less

Cr: from about 5.0% to about 10.4%

Al: about 0.1% or less

N: about 0.015% or less, wherein a sum of the C content and the N content (C+N) is about 0.020% or less Ti: from more than about 0.30% to about 0.50%, and wherein contents of Cr, Ti, C and N, ([Cr], [Ti], [C] and [N]) satisfy the following relation:

$$[Ti]/([C]+[N]) \geqq 64-4\times[Cr],$$

balance Fe and incidental impurities.

2. The steel according to claim 1, further comprising, on a weight % basis, at least one element selected from the group consisting of:

Mo: from about 0.02% to about 2.0%,

Cu: from about 0.02% to about 2.0%, and

Co: from about 0.02% to about 2.0%.

3. The steel according to claim 1 further comprising, on a weight % basis, at least one element selected from the group consisting of:

Ca: from about 0.0005% to about 0.0030%,

Nb: from about 0.001% to about 0.030%, and

B: from about 0.0002% to about 0.0050%.

4. The steel according to claim 2 further comprising, on a weight % basis, at least one element selected from the group consisting of:

Ca: from about 0.0005% to about 0.0030%,

Nb: from about 0.001% to about 0.030%, and

B: from about 0.0002% to about 0.0050%.

5. The steel according to claim 1, wherein the C content is 0.008% by weight or less.

6. The steel according to claim 1, wherein the S content is 0.005% by weight or less.

7. The steel according to claim 1, wherein the Cr content is from about 8.0% by weight to about 10.4% by weight.

8. The steel according to claim 1, wherein the sum of the C content and the N content (C+N) is 0.015% by weight or less.

9. The steel according to claim 1, wherein the Cr content is less than about 10.0% by weight.

* * * * *